US005251533A

United States Patent [19]

Layton

[11] Patent Number: 5,251,533

[45] Date of Patent: Oct. 12, 1993

[54] FIRING MODE SELECTION APPARATUS

[76] Inventor: Mark Layton, 984 South 1000 East, Orem, Utah 84058

[21] Appl. No.: 895,359

[22] Filed: Jun. 8, 1992

[51] Int. Cl.[5] ..... F41A 19/46

[52] U.S. Cl. ..... 89/142; 89/129.02

[58] Field of Search ..... 42/70.04, 70.05; 89/129.02, 142, 148

[56] References Cited

U.S. PATENT DOCUMENTS

| | | | |
|---|---|---|---|
| 3,045,555 | 7/1962 | Stoner | 89/142 |
| 3,442,173 | 5/1969 | Muller | 89/148 |
| 4,433,610 | 2/1984 | Tatro | 89/148 |

FOREIGN PATENT DOCUMENTS

| | | | |
|---|---|---|---|
| 462692 | 3/1951 | Italy | 89/148 |
| 241574 | 4/1926 | United Kingdom | 89/142 |

*Primary Examiner*—Stephen C. Bentley

*Attorney, Agent, or Firm*—Thorpe, North & Western

[57] ABSTRACT

A firing mode selector apparatus enables a rifle to be selected into one of four different modes in a logical sequence from safe to semi-automatic to burst to full automatic or vice versa. The selector lever of the rifle is configured to receive a modified sear leg which is oriented substantially diagonally and is biased against the selector sear cam. The selector lever contains cam depressions which are cut from the selector lever at a tangential angle to receive the sear leg and which take much less material from the selector lever than prior art devices.

16 Claims, 8 Drawing Sheets (PRIOR ART - SAFE MODE)

(PRIOR ART - SAFE MODE)

(PRIOR ART - BURST MODE)

(PRIOR ART - BURST MODE)

(PRIOR ART - SEMI AUTO MODE)

(PRIOR ART - SEMI AUTO MODE)

(PRIOR ART - FULL AUTO MODE)

(PRIOR ART - FULL AUTO MODE)

(SAFE MODE)

(SAFE MODE)

(SEMI AUTO MODE)

(SEMI AUTO MODE)

(BURST MODE)

(BURST MODE)

(FULL AUTO MODE)

(FULL AUTO MODE)

FIRING MODE SELECTION APPARATUS

FIELD OF THE INVENTION

The present invention concerns the field of firearms, and particularly M16 rifles and apparatuses for selecting their mode of fire.

BACKGROUND OF THE INVENTION

Modern firearms typically fire in one or more of four ways or modes: manual, in which the user pulls the trigger to fire the shot after which he must cock the gun before pulling the trigger again; semi-automatic, in which the user pulls the trigger to fire a shot and to fire the next shot simply pulls the trigger again; burst, in which pulling the trigger results in a plurality of shots, usually three, in quick succession; and full automatic, in which the weapon will continue to fire shots in quick succession as long as the trigger is pulled. Sportsmen's rifles are often manual, while military-type weapons are usually semi-automatic, burst, or automatic.

It has been found desirable to provide military personnel with weapons which can be selected to fire in one of a plurality of ways. For example, the M16, the standard rifle of the United States army, is usually provided with a firing mode selector from which the soldier can choose safe, semi-automatic, or full automatic modes, or, alternatively, safe, semi-automatic, or burst modes. This gives the soldier the flexibility to choose the mode of firing most appropriate to the situation, i.e., providing adequate firepower while remaining efficient on ammunition.

Though the three-position selector M16 has been widely used, a four-position selector, i.e., one that can be placed in safe, semi-automatic, burst, or full automatic modes, has not gained wide acceptance. This lack of acceptance is due to the difficulty of designing a selector which can select from the four modes sequentially. That is, no selector for an M16 has yet been built which goes in a logical sequence from safe to semi-automatic to burst to automatic, or vice-versa, because the current selector designs are not capable of such an arrangement. Thus, with four-mode weapons, the soldier must stop and think of where the desired firing mode position is on the selector, exposing the soldier to danger and increasing the chance of dangerous mistakes.

There exists, therefore, a need in the art for a selector which can positioned in all four modes, meaning safe, semi-automatic, burst, and full automatic, in a logical and sequential order.

OBJECTS AND SUMMARY OF THE INVENTION

It is therefore an object of the present invention to overcome the shortcomings of the prior art.

It is a further object of the invention to provide a selector for firearms which selects from four firing modes in a logical sequence.

It is a further object of the invention to improve the structure and operation of rifle selectors to enable variation of firing mode sequences.

In accordance with a first aspect of the invention, a mode selection apparatus for use in a firearm firing mechanism comprises a sear; a sear leg operatively attached to the sear and rotatably attached to the firing mechanism, the sear leg including a forward edge; means for biasing the sear and sear leg in a position wherein they are tilted toward the front of the firearm; a selector lever cam against which the forward edge of the sear leg abuts; and a cam depression disposed at a tangential angle of between 20 and 80 degrees in and to the selector lever cam, the cam depression being adapted to selectively receive the forward edge of the sear leg. In a preferred embodiment, the sear and the forward edge of the sear leg are oriented from each other at an approximate angle of between 30 and 90 degrees.

In accordance with a second aspect of the invention, a selection mode apparatus for selecting from four modes of fire of a gun, the modes being arranged to be selected in a logical sequence from safe to semi-automatic to burst to full automatic or from safe to full automatic to burst to semi-automatic, comprises a substantially cylindrical selector lever extending through and approximately perpendicular to an exterior wall of the gun, the selector lever being adapted for rotational movement to select the firing mode; a plurality of disconnector cams disposed on the selector lever for selective depression of disconnectors; a sear cam disposed on the selector lever, the sear cam being substantially cylindrical; a first cam depression cut tangentially angularly into the sear cam; a second cam depression cut tangentially angularly into the sear cam and substantially perpendicularly from and adjacent to the first cam depression; a sear; and a sear leg secured to the sear, adapted for pivotal movement, and biased against the sear cam such that it selectively enters and exits the first and second cam depressions in burst and full automatic modes as the selector lever is rotated.

Specifically, and in a preferred embodiment, a firing selection mode apparatus for use in the firing mechanism of a gun to allow for sequential selection of firing modes in either ascending or descending order, comprises a substantially cylindrical selector lever; a sear cam section disposed on the selector lever; a first cam depression facet cut tangentially angularly between 20 and 80 degrees from the sear cam section; a second cam depression facet cut tangentially angularly between 20 and 80 degrees from the sear cam section and disposed adjacent the first cam depression facet; a disconnector cam section disposed on the selector lever, being adapted to act upon the firing mechanism for operation of the gun in the selected firing mode; a sear; a sear leg attached to the sear at an angle of between 30 and 90 degrees relative thereto and adapted for rotational movement relative to the gun; means for biasing the sear leg against the sear cam section; and means for rotating the selector lever such that the sear leg selectively enters the first and second cam depression facets or rides against the curvature of the sear cam when not against the cam depression facets.

BRIEF DESCRIPTION OF THE DRAWINGS

These and other objects, aspects, and embodiments of the present invention shall be described with reference to the following drawing figures, of which.

DETAILED DESCRIPTION OF THE INVENTION

Figure 1:
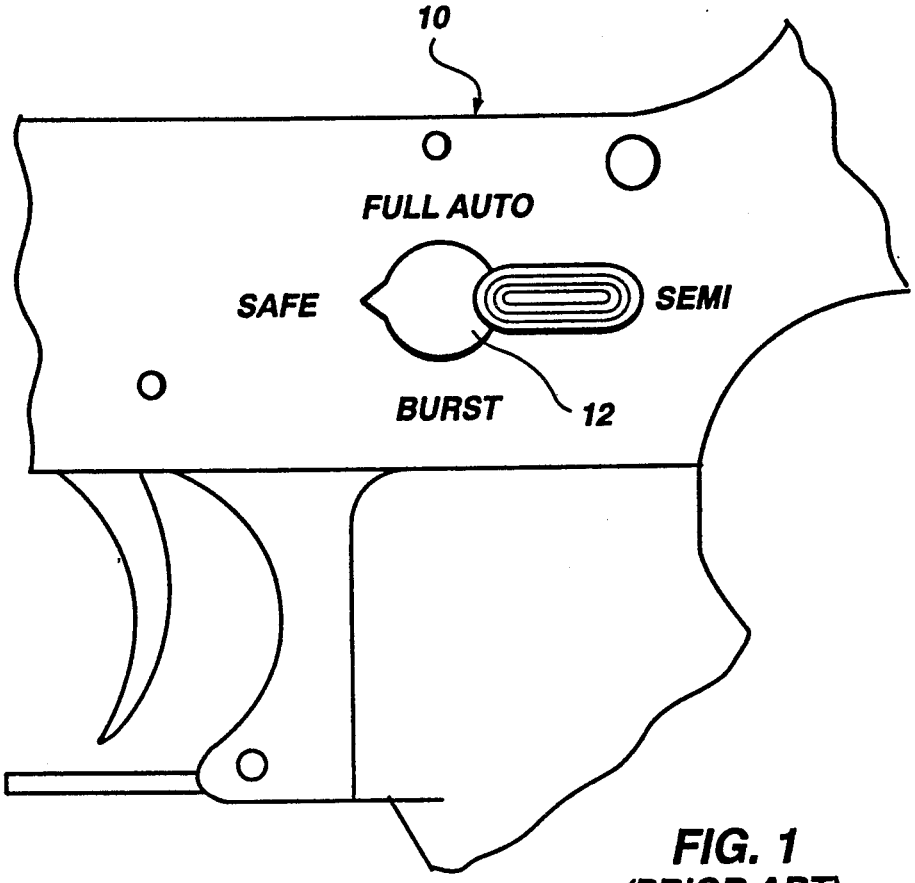
FIG. 1 (PRIOR ART)
FIG. 1 is a partial side elevational view of a four firing mode M16 rifle according to the prior art, showing the firing mode selector.

Referring first to FIG. 1, a four firing mode M16 rifle 10 according to the prior art is shown, particularly showing the selector indicator 12. The selector indicator 12 is commonly referred to as the "safety", and is used by the operator of the rifle to choose the mode of firing he desires. As can be seen in FIG. 1, prior art four-mode selectors switch from safe to full automatic to semi-automatic to burst: an illogical sequence. Alternatively, prior art selectors could go from safe to burst to semi-automatic to full automatic, which also is illogical. In any case, in prior art selectors, safe and semi-automatic must be opposite each other on the selector, as must full automatic and burst, forcing the order of choosing the modes into an illogical sequence. The need for such a sequence in prior art devices will be further detailed below. In any case, the illogical sequence of the firing modes has caused prior art devices, notably an M16 firing mechanism manufactured by Colt Industries Inc., to not receive general acceptance.

Figure 2:
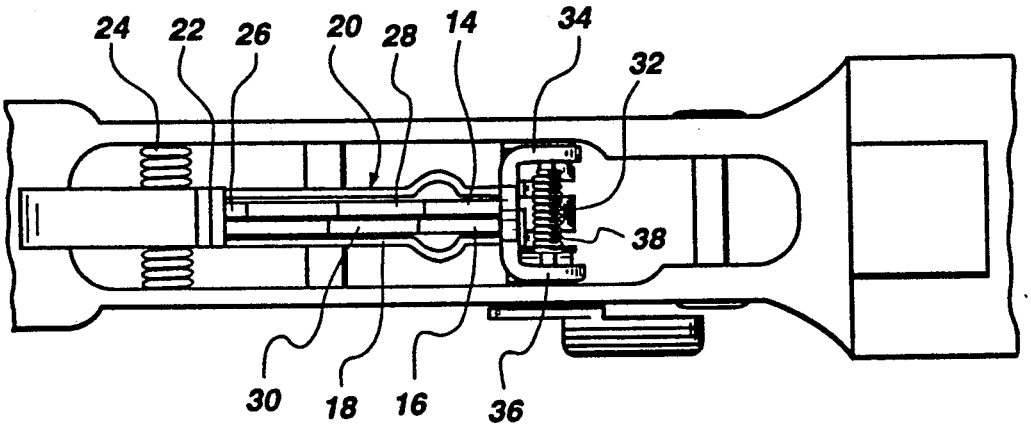
Fig. 2 (PRIOR ART)
FIG. 2 is a top plan view in cross-section of the firing mechanism of the rifle of FIG. 1.
Figure 3:
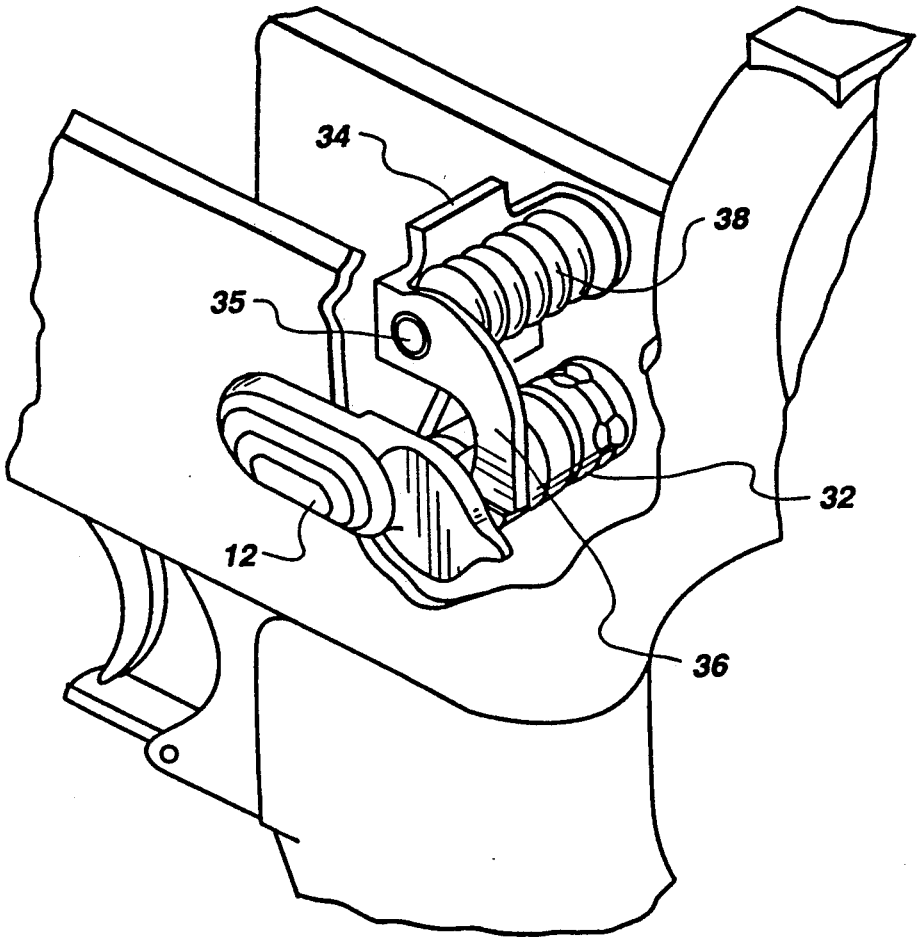
Fig. 3 (PRIOR ART)
FIG. 3 is a perspective view of the firing mechanism of the rifle of FIG. 1 in partial cutaway.

Referring now to FIGS. 2 and 3, the firing mechanism used in the prior art rifle of FIG. 1 is shown. In particular, this is an example of a firing mechanism manufactured by Colt Industries in an attempt at a four firing mode rifle. In this type of firing mechanism, a burst disconnector 14 and a semi-automatic disconnector 16 reside within a trough 18 in the trigger 20. A hammer 22 pivots on a clutched cam assembly 24 which is engaged by a front hook 26 of the burst disconnector 14 for monitoring the number of shots fired in the burst. The burst cam assembly 24 and front hook 26 are configured, as is known in the art, for the desired number of shots in a burst, typically three.

The disconnectors 14 and 16 each have rear hammer arresting hooks 28 and 30 which operate to arrest the movement of the hammer 22 and to hold it back in the cocked position. The arresting hooks 28 and 30 are configured as is known in the art, and are used to hold the hammer 22 back after a burst or semi-automatic firing.

Figure 5:
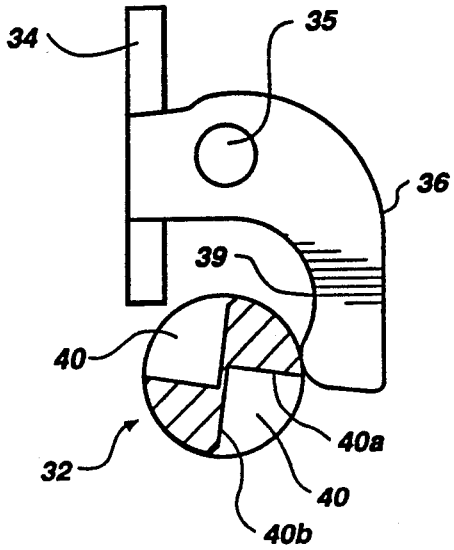
FIG. 5 is a side elevational view in cross-section along line 5—5 in FIG. 4, showing the position of the sear leg.

A selector lever 32, extending through the walls of the rifle 10 into the firing mechanism from the selector indicator 12, and being securely attached to the indicator, is disposed above the disconnectors 14 and 16 for selective depression thereof, the exact mechanism of which is detailed below. A sear 34 is disposed above the selector lever 32, and includes a sear leg 36 comprising a right angled piece of metal which is biased against the selector lever 32 by means of a spring 38 disposed on the leg 36. The sear 34 and the forward edge of the sear leg 36, which contacts the selector lever, shown at 39 in FIG. 5, are parallel. The sear leg pivots on a pin 35.

Figure 4:
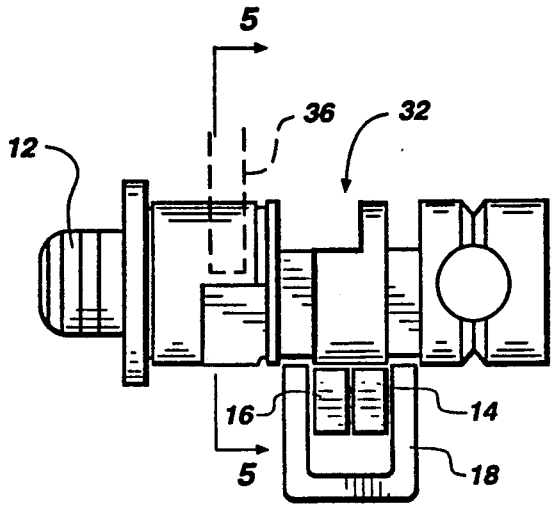
FIG. 4 is a rear elevational view of the selector lever used in the firing mechanism of FIG. 2, in the safe position.
Figure 6:
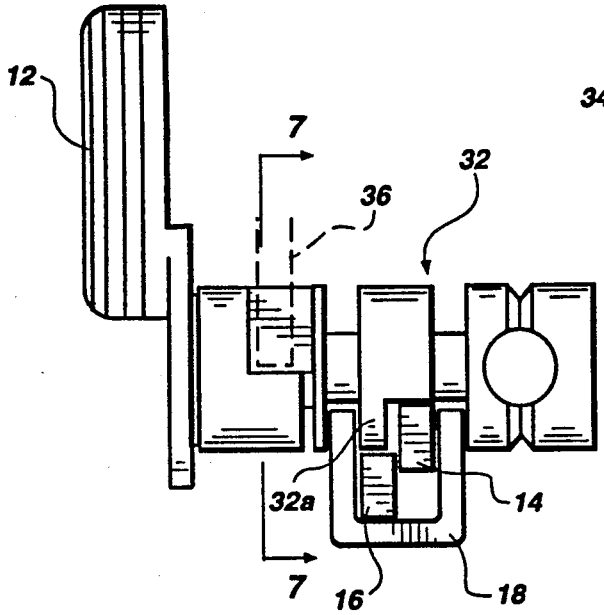
FIG. 6 is a rear elevational view of the selector lever of FIG. 4 in the burst position.
Figure 7:
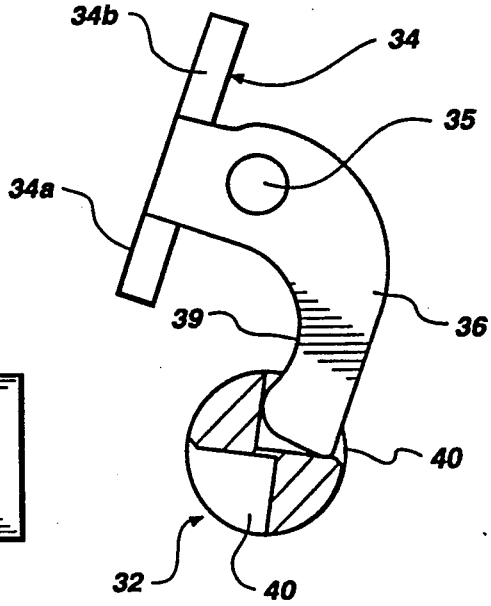
FIG. 7 is a side elevational view in cross-section along line 7—7 in FIG. 6.
Figure 8:
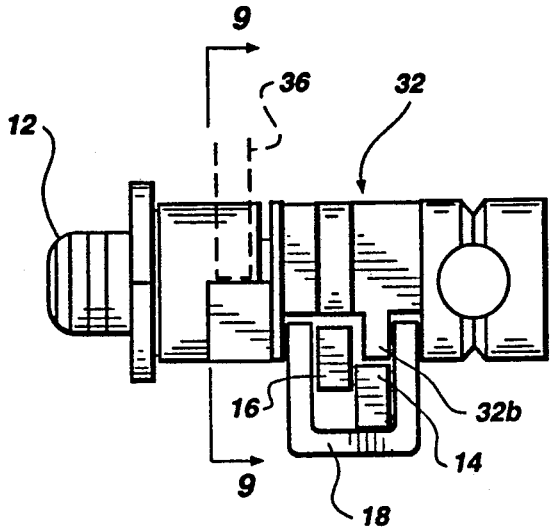
FIG. 8 is a rear elevational view of the selector lever of FIG. 4 in the semi-automatic position.
Figure 9:
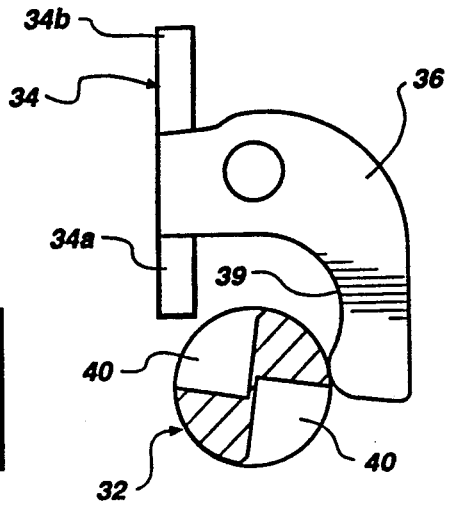
FIG. 9 is a side elevational view in cross-section along line 9—9 in FIG. 8.
Figure 10:
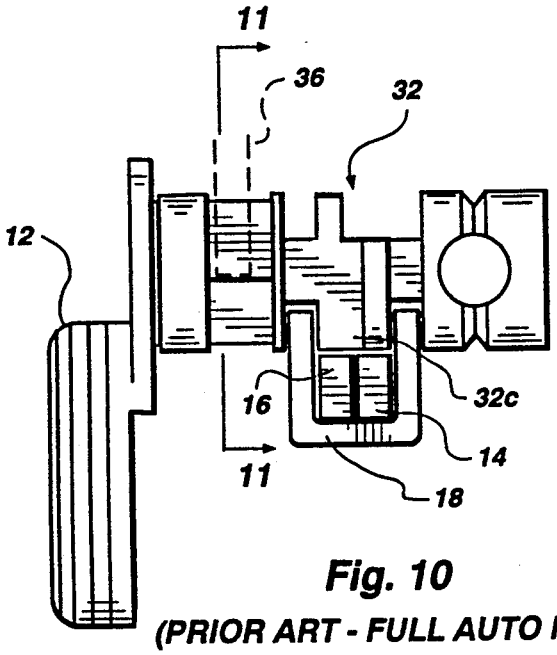
FIG. 10 is a rear elevational view of the selector lever of FIG. 4 in the full automatic position.

Referring now to FIGS. 4 to 11, the selector lever 32 is configured such that the sear leg 36 abuts it near the end thereof attached to the indicator 12 and such that the rest of its length selectively depresses the disconnectors and permits or restricts the action of the hammer. This is done by configuring the selector lever 32 in a cammed arrangement which contains a plurality of cams which selectively come in contact with the disconnectors 14 and/or 16. As can be seen in FIG. 4, when the selector indicator 12 is in the safe position, neither disconnector is depressed by the selector lever 32. Pursuant to mechanisms known in the art, when neither disconnector is depressed, and the trigger is unable to pivot, the firing mechanism will not operate. In FIG. 6, the burst position, a cam 32*a* depresses the semi-automatic disconnector 16. In FIG. 8, the semi-automatic position, a cam 32*b* depresses the burst disconnector 14. In FIG. 10, the full automatic position, a cam 32*c* depresses both disconnectors 14 and 16.

When the semi-automatic disconnector 16 is depressed by the cam 32*a* on the selector lever 32, as in FIG. 6, the rear hammer arresting hook 30 on the disconnector 16 is moved rearwardly such that it does not contact the hammer 22 and thereby hold it back in the cocked position. The action of the hammer thereby is controlled by the burst disconnector 14, together with the sear 34, and will fire in the burst mode. This is done by configuring the clutched cam assembly 24 which contacts the front hook 26 of the burst disconnector 14 and pushes it back during the burst such that the rear hammer arresting hook 28 is held behind the hammer 22, preventing arresting movement of the hammer during the number of shots in the burst. After the desired number of shots, the cam assembly 24 is configured to allow the front hook 26 to move forwardly, thereby also allowing the rear hammer arresting hook 28 to move forwardly and arrest movement of the hammer, stopping the burst and keeping the hammer in the arrested position until the trigger is released, then pulled again.

Each time the hammer 22 moves forward and fires a shot, a conventional recoil mechanism forces the hammer back to automatically cock it for another shot. As has been discussed above, in the burst mode the hammer 22 is allowed to automatically fire the number of shots in the burst, usually three, before being arrested by the hammer arresting hook 28 and ending the burst. During the burst, however, the hammer is momentarily arrested between shots by the positioning of the sear 34. The reason for momentarily arresting the hammer between shots in the burst is to allow time for the recoil mechanism of the rifle to load a fresh cartridge in the breach in preparation for a subsequent shot. As can be seen in FIG. 7, in the burst mode the sear 34 is tilted such that its bottom portion 34*a* is thrust forwardly (the details of the positioning of the sear leg 36 to achieve this orientation are discussed below). When the hammer 22 is thrust backwardly after a shot, the bottom portion 34*a* of the sear catches the hammer and holds it in position until a fresh cartridge is loaded and the rifle is ready to fire again. The upper portion 34*b* of the sear is then pushed forwardly by the bolt carrier in its forward motion as part of the recoil mechanism, causing the lower portion 34*a* to move rearwardly and release the hammer.

It will be appreciated by those skilled in the art that the sear 34 cannot act as a hammer arrester in the same way as the hooks 28 and 30 in present firing mechanism configurations, since conventional recoil mechanisms will always cause the sear 34 to release the hammer after holding it only a very short time. After the shots in the burst are completed and the sear 34 releases the hammer for the last time, the hammer is caught by the rear hook 28 which arrests its movement until the trigger is pulled again.

When the burst disconnector 14 is depressed by the cam 32*b* on the selector lever 32, as in FIG. 8, the rear hammer arresting hook 28 on the disconnector 14 is moved rearwardly such that it does not contact the hammer 22 and thereby hold it back in the cocked position. The action of the hammer thereby is controlled by the semi-automatic disconnector 16, with the sear 34 being non-functional in its vertical position, and will fire in the semi-automatic mode. In this mode, the rear hammer arresting hook 30 on the disconnector 16 will arrest the hammer 22 each time it comes back after firing a shot, limiting the number of shots to one (1) each time the trigger is pulled. In this mode, the sear 34 is positioned vertically, i.e., with the bottom portion 34*a* being positioned rearwardly and thereby out of range of contact with the hammer. There is no need for the sear 34 to operate with the hammer in this mode since only one shot is fired at a time, and consequently the sear is positioned out of the way of the hammer, as is appreciated by those skilled in the art.

When both disconnectors 14 and 16 are depressed by the cam 32*c* on the selector lever 32, as in FIG. 10, both rear hammer arresting hooks 28 and 30 are moved rearwardly such that they do not contact the hammer 22 and thereby hold it back in the cocked position. The action of the hammer thereby is controlled solely by the sear 34 and will fire in the full automatic mode. In this mode, the hammer arresting hooks 28 and 30 do not arrest the hammer until the trigger is released, and thus the hammer will continue to fire as long as the trigger is depressed. The sear 34 is positioned as in the burst mode, FIG. 7, and performs the same function as in that mode.

It can be seen that in the burst and full automatic modes, the sear 34 must be tilted forwardly at its lower end to contact the hammer 22, while in the safety and semi-automatic modes, the sear 34 should be tilted rearwardly at its lower end to avoid contact with the hammer since the hammer's action should solely be dictated by the arresting hooks in those modes. The orientation of the sear 34 is determined by the contact of the sear leg 36 against the selector lever 32. When the sear 34 is desired to be tilted forwardly, the sear leg 36 is placed into a cut-out portion of the selector lever 32, or a cam depression 40, allowing the sear leg to move forwardly and accordingly tilt the sear 34. The shaping and magnitude of the cam depressions of the selector lever 32 have proven to be difficult in creating a four firing mode rifle.

Figure 11:
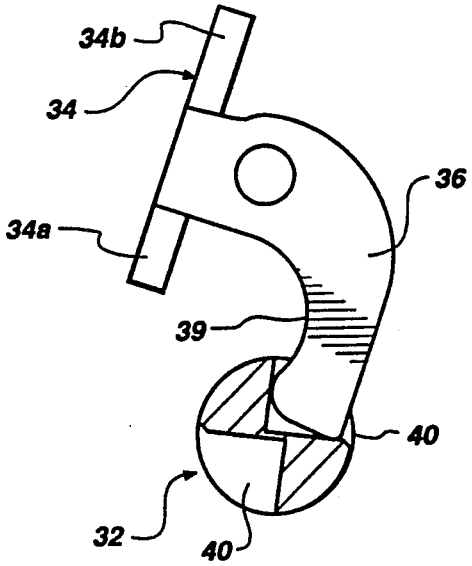
FIG. 11 is a side elevational view in cross-section along line 11—11 in FIG. 10.
Figure 11A:
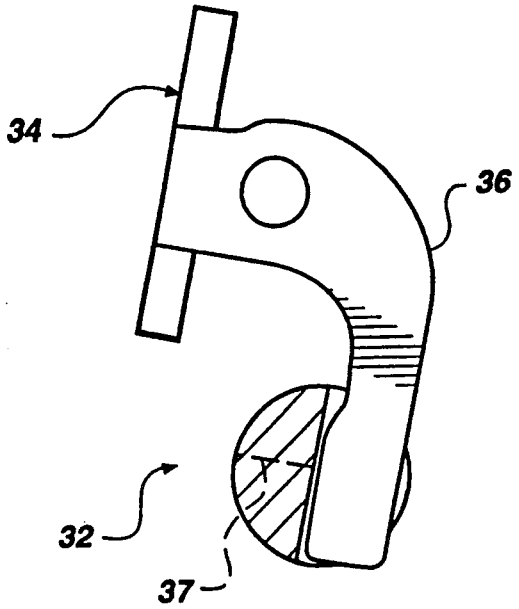
Fig. 11A (PRIOR ART)
FIG. 11A is a side elevational view in cross section of another example of a firing mechanism according to the prior art.

Referring to FIG. 11A, in previous three firing mode rifles, e.g., safety, semi-automatic, and burst, or safety, semi-automatic, and full automatic, the sear leg 36 was relatively long and the cam depression of the selector lever 32 in the burst (or full automatic) mode comprised approximately half of the portion of the selector lever 32 which contacted the sear leg. In a four-mode rifle, in order to locate the burst mode a quarter-turn of the selector indicator 12 from the full automatic mode, in a logical sequence, it would have been necessary to remove in addition the portion of the selector lever 32 above the dotted line 37 in FIG. 11A, leaving insufficient material in the selector lever 32 for requirements of strength and support of the sear leg 36 in the safety and semi-automatic modes. The situation was even worse in attempting to locate the burst and full automatic modes a half-turn of the selector indicator 12 from each other, an illogical sequence, since the entire selector lever 32 would have to be removed to accommodate the cam depressions of the two modes. This was obviously impossible, so other means had to be found.

The next attempt in the prior art to configure the selector and sear leg for a four mode rifle was to shorten the sear leg 36, as in FIGS. 4 to 11, so that only slightly more than one-quarter of the material of the selector lever 32 needed to be removed for creation of a cam depression 40 in the burst mode and another one-quarter for the full automatic mode, FIGS. 7 and 11.

As can be seen in FIGS. 5, 7, 9, and the cam depressions 40 are each formed by cutting away slightly more than one-quarter of the material in the cross-sectional area of the selector lever. The depressions 40 are formed from two cuts 40*a* and 40*b* (FIG. 5) which are approximately perpendicular to the tangent of the selector lever at the point at which they intersect the circumference thereof. This arrangement of the sear and sear arm and shape of the cam depression, however, necessitated the illogical sequence of placing the burst and full automatic modes one-half turn from each other, since cam depressions located next to each other on the selector lever 32 would not have any material between them. This would cause the sear arm 36 to move forwardly too far in one mode, tilting the sear 34 too much, as well as unbalancing and weakening the selector lever. Rifles containing the resulting illogical sequence firing mode mechanisms, manufactured by concerns such as COLT, NORRELL and DPMS, have therefore gained limited acceptance.

Figure 12:
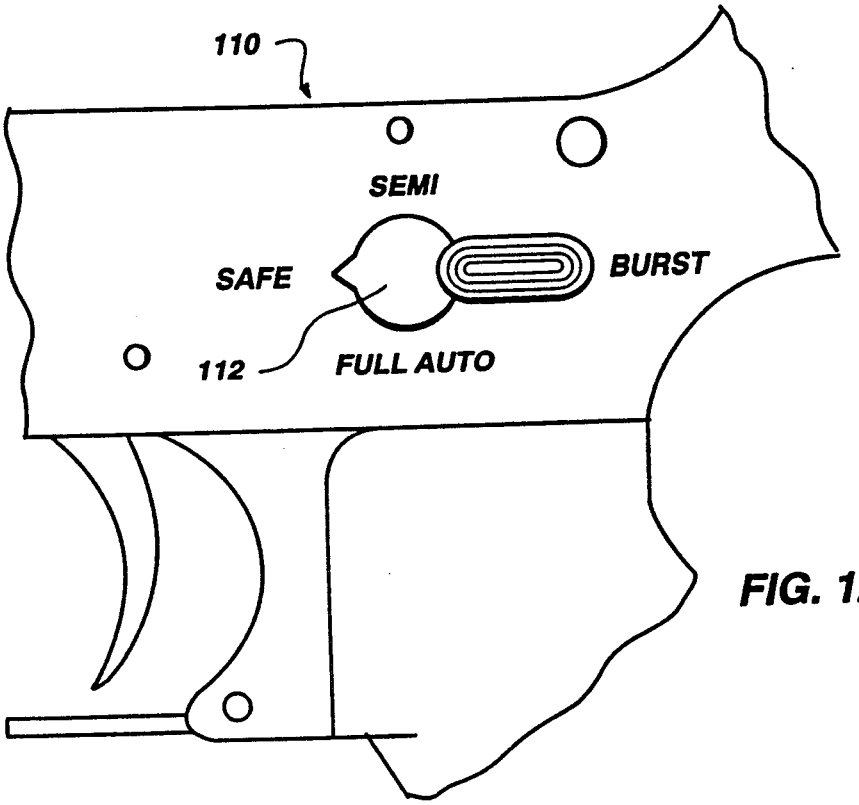
FIG. 12 is a partial side elevational view of a four firing mode M16 rifle according to the invention, showing the firing mode selector.
Figure 13:
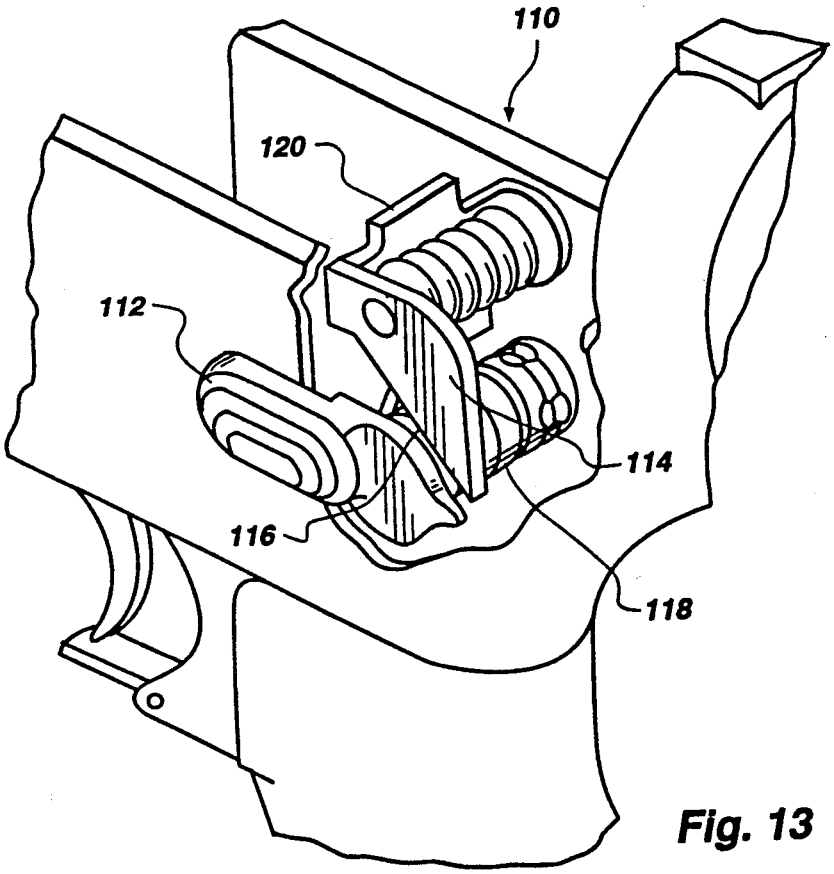
FIG. 13 is a perspective view in partial cutaway of the firing mechanism of the rifle of FIG. 12.

Referring now to FIG. 12, a four firing mode M16 rifle 110 according to the invention is shown, particularly showing the selector indicator 112. The selector indicator 112 according to the invention switches from safe to semi-automatic to burst to full automatic modes, a logical sequence. The basic firing mechanism in the rifle 110 is similar to that previously described except for the shape of the selector lever and the relationship of the sear and sear leg. FIG. 13 illustrates the inventive shape of an example of a sear leg 114 according to the invention which enables the logical sequence of firing modes. Unlike the sear leg 36 in the prior art firing mechanism previously described, the sear leg 114 has a diagonal orientation at the forward edge 116 where it contacts the selector lever 118. Instead of the sear and the portion of the sear leg which contacts the selector lever being parallel, the sear 120 and the edge 116 of the sear leg are oriented approximately 45 degrees from each other in the preferred embodiment.

Although the 45 degree angle between the sear 120 and edge 116 shown has been found to be preferable, other angles can be just as effective. Based on prior art information in light of this disclosure, those skilled in the art will be able to experiment to find the angle suitable for their particular application which preserves sufficient material in the selector lever while allowing the sear leg to enter the selector lever a sufficient distance to be secure in its position. It is contemplated that this angle may vary anywhere from 30 to 90 degrees.

As shown in FIGS. 14–21, because of the increased angle between the sear 120 and the sear leg edge 116, the sear leg 114 contacts the selector lever 118 higher on the latter than do prior art devices in the safety and semi-automatic modes. In the prior art, as shown in FIG. 5, the sear leg 36 contacts the selector lever 32 at a three o'clock position, whereas the sear leg 114 contacts the selector lever 118 at approximately a one o'clock position in the safety and semi-automatic modes, as illustrated by FIGS. 14–15 and 16–17. The changing of the angle between the sear leg edge 116 and the sear 120 thereby effectively further shortens the sear leg, at least insomuch as the material required to be cut out of the selector lever for cam depressions is concerned.

Because of the modified shape of the sear leg 114, less material needs to be cut out of the selector lever 118 in order to form cam depressions to tilt the sear forwardly in the burst and full automatic modes. It can be seen that as the angle between the sear leg edge 116 and the sear 120 increases, the angle at which the selector lever must be cut to accommodate the sear leg 114 decreases, accordingly decreasing the amount of material needed to be cut. For example, it can be seen in FIG. 7 that the angle between the edge 39 and the sear 34 requires a substantially tangentially perpendicular cut into the selector lever 32, since the sear leg enters the selector lever at approximately a right angle, removing a large amount of material therefrom. It can be seen in FIG. 21, however, that the selector lever of the invention need only be cut at approximately a 60 degree angle tangentially, causing the sear leg to be oriented at approximately 30 degrees from vertical when placed in the cam depression, eliminating the need to cut so much material from the selector lever 118. Additionally, since the end of the sear leg 114 does not enter the selector lever 118 in those modes, the material cut out need not be a notch but merely a tangential cut. It is contemplated that the tangential angle of the cut can be varied anywhere from 20 to 80 degrees.

Given the small amount of material needed to be removed from the selector lever 118 for the cam depressions, the burst and full automatic modes of the rifle 110, shown in FIGS. 18–19 and 20–21, can be placed next to each other. Whereas in prior art devices such an arrangement would cut away the vast majority of the selector lever, in the present invention a large majority of the selector lever material, sufficient to maintain strength and support of the sear leg 114 in the safe and semi-automatic modes, is preserved.

Figure 14:
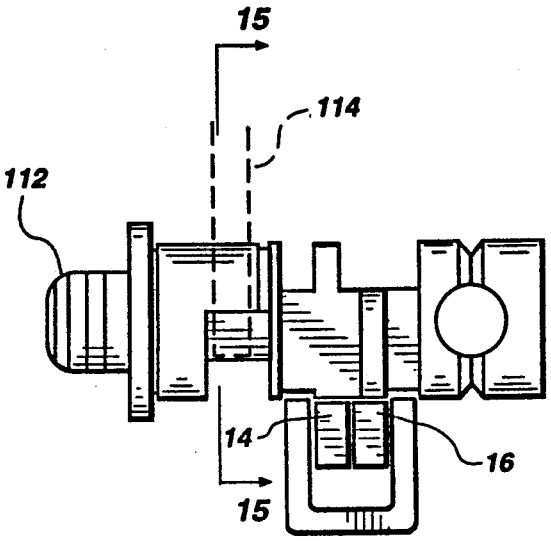
FIG. 14 is a rear elevational view of the selector lever used in the firing mechanism of FIG. 13, in the safe position.
Figure 15:
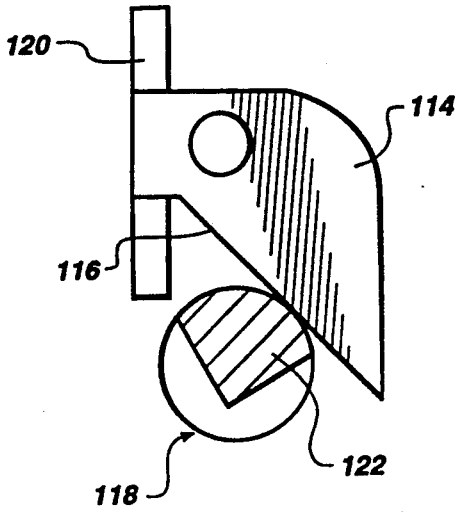
FIG. 15 is a side elevational view in cross-section along line 15—15 in FIG. 14, showing the position of the sear leg.
Figure 16:
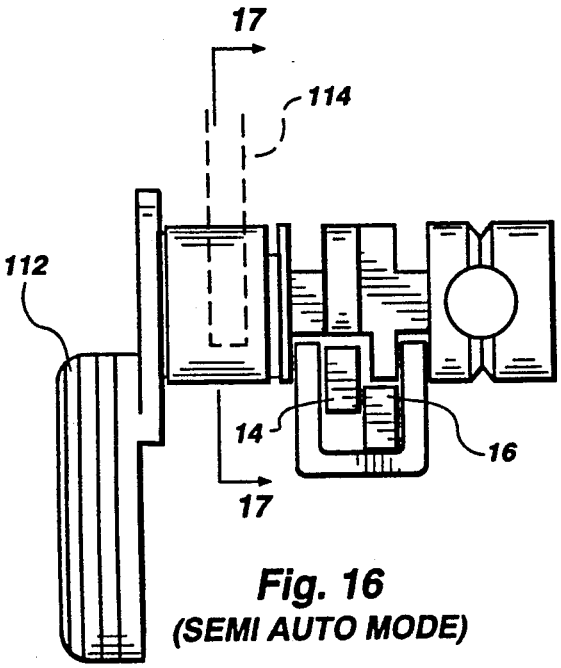
FIG. 16 is a rear elevational view of the selector lever of FIG. 14 in the semi-automatic position.
Figure 17:
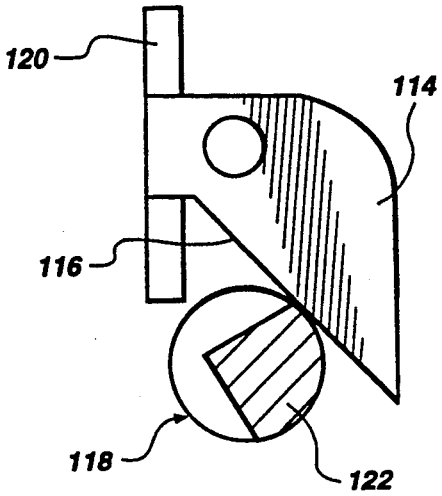
FIG. 17 is a side elevational view in cross-section along line 17—17 in FIG. 16.
Figure 18:
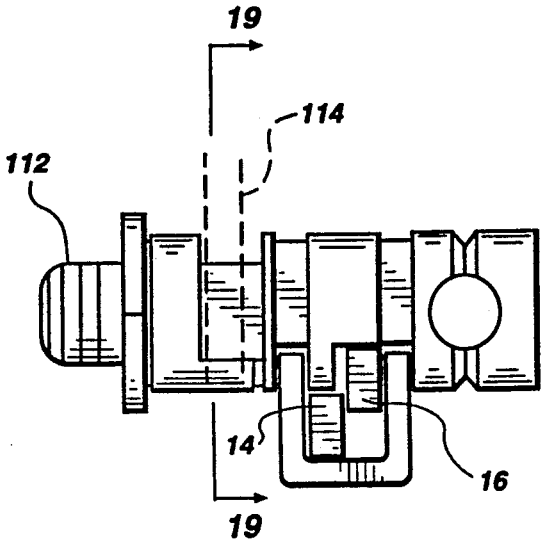
FIG. 18 is a rear elevational view of the selector lever of FIG. 14 in the burst position.
Figure 19:
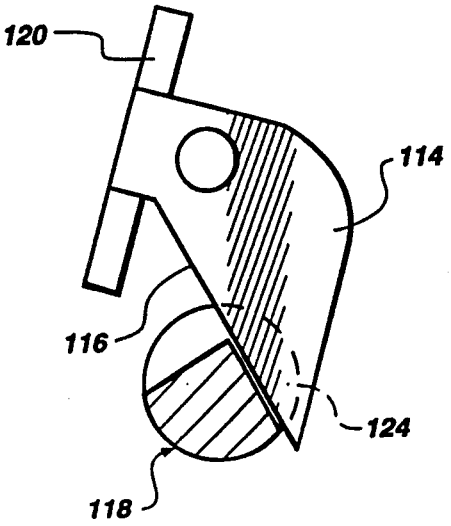
FIG. 19 is a side elevational view in cross-section along line 19—19 in FIG. 18.
Figure 20:
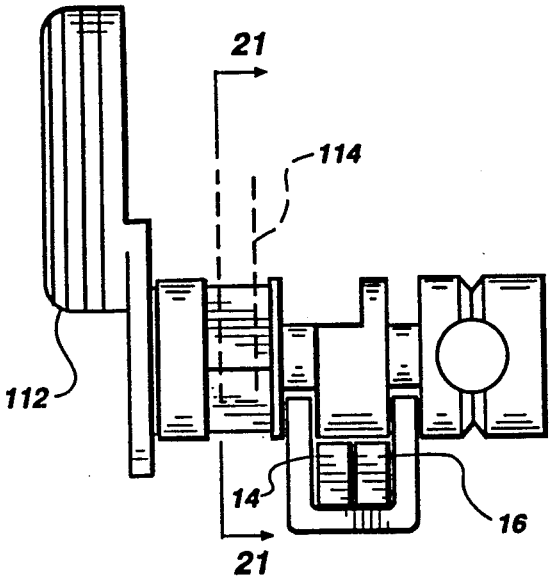
FIG. 20 is a rear elevational view of the selector lever of FIG. 14 in the full automatic position.
Figure 21:
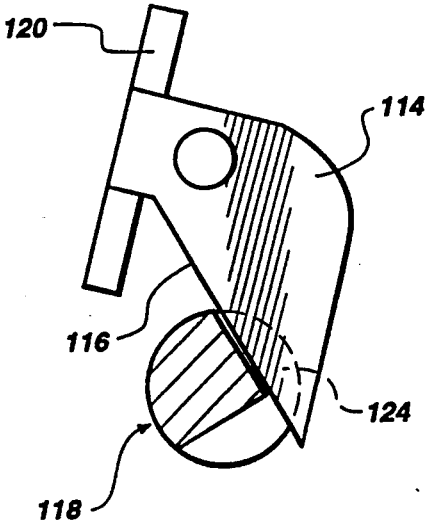
FIG. 21 is a side elevational view in cross-section along line 21—21 in FIG. 20.

In the safe position, FIGS. 14–15, wherein neither disconnector 14 or 16 is depressed, the sear leg 114 rests upon the portion 122 of the selector lever 118 which is intact. As the selector indicator 112 is turned a quarter turn to put the rifle into semi-automatic mode, FIGS. 16–17, depressing the burst disconnector 16, the sear leg 114 continues to rest upon the portion 122. As the selector indicator 112 is again turned a quarter turn to burst mode, FIGS. 18–19, depressing the semi-automatic disconnector 14, the sear leg 114 falls into the cutout portion or cam depression 124, volumetrically much less than the cutout portion of the selector lever 32, to put the sear 120 into forward tilted position. As the selector indicator 112 is further turned a quarter turn to full automatic mode, FIGS. 20–21, depressing both disconnectors 14 and 16, the sear leg 114 falls into the second cutout portion or cam depression 124 to put the sear into forward tilted position.

Though not the preferred embodiment, the inventive shape of the sear leg 114 also permits shaping of the cam depressions in the selector lever 118 to allow for oppositely positioned burst and full automatic modes, as in the prior art, since so little material is removed.

It can be seen from the above description that the increasing of the angle from the sear to the sear leg from the prior art zero (0) degrees reduces the material needed to be removed from the selector lever and thus enables the burst and full automatic modes to be placed adjacent each other.

It will be appreciated that modifications and variations to the embodiments of the invention described herein are possible while remaining within the scope of the invention. The described embodiments are not meant to be definitive of the scope of the invention but rather to serve as examples of its application in manufacture and in particular applications.

I claim:

1. Mode selection apparatus for use in a firearm firing mechanism comprising: a sear; a sear leg attached to the sear and rotatably attached to the firearm, the sear leg including a forward edge; means for biasing the sear and sear leg in a position wherein they are tilted toward the front of the firearm; a selector lever cam against which the forward edge of the sear leg abuts; and a cam depression;

characterized in that the cam depression is disposed at a tangential angle of between 20 and 80 degrees in and to the selector lever cam, the cam depression being positioned to selectively receive the forward edge of the sear leg such that four modes of firing the firearm are arranged to be selected in a logical sequence from safe to semi-automatic to burst to full automatic or from safe to full automatic to burst to semi-automatic.

2. The apparatus of claim 1 wherein the forward edge of the sear leg contacts the selector lever cam between a twelve o'clock and a three o'clock position when not located in the cam depression.

3. The apparatus of claim 1 wherein at least portions of the forward edge of the sear leg and the cam depression are co-extensive when the forward edge of the sear leg is received in the cam depression.

4. The apparatus of claim 1 further comprising a selector lever, at least a portion of the selector lever being cylindrical, upon which the selector lever cam is disposed and means for rotating the selector lever such that the sear leg is selectively placed into and out of the cam depression.

5. The apparatus of claim 1 further comprising a second cam depression disposed at substantially right angles to and adjacent the first cam depression.

6. The apparatus of claim 1 wherein the selector lever cam is at least partially cylindrical and the cam depression is an angular depression in the selector lever cam.

7. The apparatus of claim 4 wherein the cam depression is disposed at substantially a 60 degree tangential angle from the selector lever.

8. Selection mode apparatus for selecting from four modes of fire of a gun, the modes being arranged to be selected in a logical sequence from safe to semi-automatic to burst to full automatic or from safe to full automatic to burst to semi-automatic, comprising:

a selector lever extending through and approximately perpendicular to an exterior wall of the gun, at least a portion of the selector lever being cylindrical and also being adapted for rotational movement to select the firing mode;

a plurality of disconnector cams disposed on the selector lever for selective depression of disconnectors;

a sear cam disposed on the selector lever, at least a portion of the sear cam being cylindrical;

a first cam depression cut tangentially angularly into the sear cam;

a second cam depression cut tangentially angularly into the sear cam and perpendicularly from and adjacent to the first cam depression;

a sear;

a sear leg secured to the sear, adapted for pivotal movement, and biased against the sear cam such that it selectively enters the first and second cam depressions in burst and full automatic modes as the selector lever is rotated.

9. The apparatus of claim 8 wherein the sear leg contains a straight edge which contacts the sear cam, and wherein the sear is oriented at an angle of between 30 and 90 degrees from the sear leg edge.

10. The apparatus of claim 9 wherein the sear is oriented at an angle of 45 degrees from the sear leg edge.

11. The apparatus of claim 10 wherein the sear leg is oriented at 30 degrees from vertical when located in the first or second cam depressions.

12. The apparatus of claim 10 wherein the sear leg contacts the sear cam outside the cam depressions at a one o'clock position.

13. The apparatus of claim 10 wherein the cam depressions comprise flat facets cut from the selector lever cam and located adjacent each other.

14. Firing selection mode apparatus for use in the firing mechanism of a gun to allow for sequential selection of firing modes in either ascending or descending order, comprising:

a selector lever disposed in and between two walls of the gun, at least a portion of the selector lever being cylindrical;

a sear cam section disposed on the selector lever;

a first cam depression facet cut tangentially angularly between 20 and 80 degrees from the sear cam section;

a second cam depression facet cut tangentially angularly between 20 and 80 degrees from the sear cam section and disposed adjacent the first cam depression facet;

a disconnector cam section disposed on the selector lever, being positioned to act upon the firing mechanism for operation of the gun in the selected firing mode;

a sear;

a sear leg attached to the sear at an angle of between 30 and 90 degrees relative thereto and positioned for rotational movement relative to the gun;

means for biasing the sear leg against the sear cam section;

means for rotating the selector lever such that the sear leg selectively enters the first and second cam depression facets such that four modes of firing the gun are arranged to be selected in a logical sequence from safe to semi-automatic to burst to full automatic or from safe to full automatic to burst to semi-automatic.

15. The apparatus of claim 14 wherein the first and second cam depression facets are cut at a tangential angle of 60 degrees from the sear cam section.

16. The apparatus of claim 14 wherein the sear leg is attached to the sear at an angle of 45 degrees.

* * * * *